US006052828A

United States Patent [19]

Widdemer

[11] Patent Number: 6,052,828

[45] Date of Patent: Apr. 25, 2000

[54] QUIET ADJUSTABLE CLOSURE FOR GOLF GLOVES, OTHER SPORT GLOVES, GARMENTS AND CONTAINERS

[75] Inventor: John D. Widdemer, Gloversville, N.Y.

[73] Assignee: Bali Leathers, Inc., Johnstown, N.Y.

[21] Appl. No.: 09/340,790

[22] Filed: Jun. 28, 1999

Related U.S. Application Data

[60] Provisional application No. 60/091,612, Jul. 2, 1998, and provisional application No. 60/117,636, Jan. 28, 1999.

[51] Int. Cl.[7] ..... A41D 19/00

[52] U.S. Cl. ..... 2/161.2; 2/159; 24/303; 600/9

[58] Field of Search ..... 2/159, 161.1, 161.2, 2/161.4, 161.5, 162; 24/303; 273/317.2; 224/108.2, 918; 473/205; 600/9, 15

[56] References Cited

U.S. PATENT DOCUMENTS

| | | | |
|---|---|---|---|
| 3,136,547 | 6/1964 | Schaper | 24/303 |
| 3,462,862 | 8/1969 | Chase | 24/303 |
| 4,249,267 | 2/1981 | Voss | 2/69 |
| 4,639,947 | 2/1987 | Lanscioni | 2/161 |
| 4,691,388 | 9/1987 | Boone | 2/161 |
| 4,736,494 | 4/1988 | Marchesi | 24/303 |
| 5,604,960 | 2/1997 | Good | 24/303 |
| 5,715,539 | 2/1998 | Benecki et al. | 2/160 |
| 5,720,046 | 2/1998 | Lopez et al. | 2/159 |

*Primary Examiner*—Diana Oleksa
*Assistant Examiner*—Katherine Moran
*Attorney, Agent, or Firm*—Aufrichtig Stein & Aufrichtig, P.C.; Peter D. Aufrichtig

[57] ABSTRACT

A glove having palm, back and finger portions with an opening in the back, side or palm portions between a flap portion and the bonding location. A magnetic closure coupled to the flap portion and the bonding location proximate the opening is formed of a soft magnet secured to the back of the glove whereby a comfortable, adjustable and quiet opening closure is provided. The glove provides enhanced fit without the distracting noise of a hook and pad closure when opened. A magnetic golf ball marker releasably attaches to the glove.

15 Claims, 3 Drawing Sheets

QUIET ADJUSTABLE CLOSURE FOR GOLF GLOVES, OTHER SPORT GLOVES, GARMENTS AND CONTAINERS

This application claims benefit of provisional application No. 60/091,612 filed Jul. 2, 1998, this claims benefit of provisional application No. 60/117,636 filed Jan. 28, 1999.

BACKGROUND OF THE INVENTION

The invention is generally directed to the design of gloves and, in particular, to improved golf and other sport gloves with quiet adjustable wrist closures. In many sports and most particularly in connection with playing golf, the ability to concentrate fully on the game, especially while putting, is critical to success.

Currently, substantially all golf gloves are open backed with a Velcro® tab closure. The tab not only serves to keep the glove closed during play, and allows easy removal and entry, but, more importantly, allows adjustability of the fit of the glove to accommodate the varying widths of human hands. This is particularly relevant in golf, as in most sports, where gloves are worn to provide a better grip on the playing instrument and the glove must fit smoothly and exactly across the palm of the wearer's hand to avoid wrinkles which could cause discomfort, blisters and callouses and poor contact with the golf club or other playing instrument.

The use of Velcro® in closing golf gloves is known and particular attention is drawn to U.S. Pat. Nos. 3,372,401; 3,588,917; 3,600,715; 4,040,126 and 4,402,977. While Velcro® has worked well as to its adjustability and closure strength, a major drawback is the loud ripping noise it makes when the gloves are opened. Most golfers remove their glove prior to putting and the loud ripping sound of opening Velcro® is a serious distraction to the concentration of other golfers who may be at the critical moment of striking a putt when another member of the golfing foursome opens his or her glove. The same distraction also often happens during other phases of the game, whether during driving or hitting fairway strokes as players adjust their glove fit in preparation for their shots. In addition, the Velcro® hook and mat fastener, especially the hook portion, is quite stiff and detracts from the overall comfortable fit of the glove, especially when the hand is bent backwards. Accordingly, there is a need for a soft, silent and adjustable closure for golf and other sport gloves.

SUMMARY OF THE INVENTION

The invention is generally directed to a soft, silent and widely adjustable closure for golf and other sports gloves achieved through application of soft magnet technology. Today, magnetic materials can be impregnated into soft stitchable plastic. The advanced magnetic materials utilized in connection with the invention provide a comparable holding force to those of Velcro® pads, the traditional golf glove closures.

The invention is also generally directed to an improved quiet adjustable closure for a glove incorporating a magnetized ferro impregnated plastic consisting of iron oxide blended with barium carbonate in the range of 0.035 inches to 0.060 inches thick with a poles per inch magnetization of 10 or more preferably in a checkerboard pattern in which the holding power of the magnetic closure is increased and the closure is made more adjustable when both sides of the closure are magnetized and backed by a flexible steel foil having sufficient thickness to incorporate substantially all of the magnetic flux from the magnetized ferro impregnated plastic. In a preferred embodiment, the steel foil used in the magnetic closure should be a silicon steel, painted or otherwise coated to prevent rusting which would occur from contact with the glove wearer's sweat.

Accordingly, it is an object of the invention to provide an improved closure for golf and other sports gloves incorporating one or more magnet panels which mate with each other or with a metallic station to form a silent glove closure.

Still another object of the invention is to provide an improved silent glove closure for golf and other sport gloves incorporating widely adjustable magnetic closures to allow easy access, entry and removal of the glove.

Still a further object of the invention is to provide an improved quiet adjustable closure for a glove or other garment or bag which provides for silent opening and closing, broadly adjustable closure and alignment features to assure proper control of the closure.

Yet still another object to the invention is to provide a glove closure which is silent when being unfastened.

Yet another object of the invention is to provide a glove closure which is soft, flexible and comfortable to wear in all positions.

Still another object of the invention is to provide an improved magnetic ball marker which can attach to the glove in a desired location or locations and then can be easily placed on the ground with a flat profile which is less likely to interfere with other players' putting.

Still other objects and advantages of the invention will, in part, be obvious and will, in part, be apparent from the specification.

The invention accordingly comprises the features of construction, combination of elements, arrangement of parts, combinations of steps and procedures, all of which will be exemplified in the constructions and processes hereinafter set forth and the scope of the invention will be indicated in the claims.

BRIEF DESCRIPTION OF THE DRAWINGS

For a fuller understanding of the invention, reference is had to the following descriptions taken in connection with the accompanying drawings, in which.

DETAILED DESCRIPTION OF THE PREFERRED EMBODIMENTS

Figure 1:
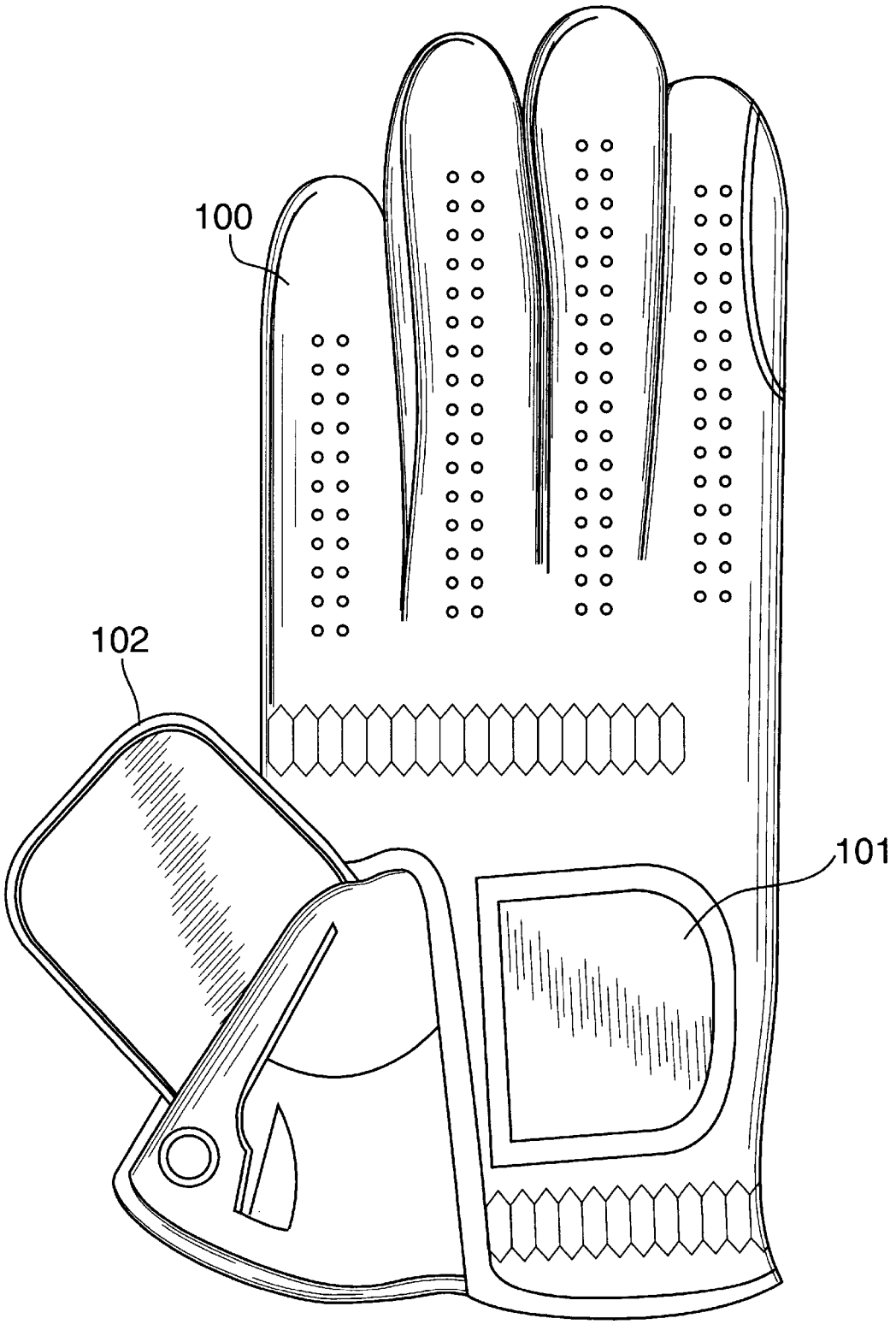
FIG. 1 is a top plan view of a golf glove constructed in accordance with a preferred embodiment of the invention with one of the closure tabs folded backward.

Reference is first made to FIG. 1 wherein a golf glove 100 constructed in accordance with a preferred embodiment of the invention is depicted. Golf glove 100 is constructed generally in accordance with conventional glove technology but also includes soft magnetic tabs 101 and 102 which attract each other when tab 102 overlies tab 101. Tab 102 can be pulled over tab 101 either so that tabs 101 and 102 lie directly over each other, so that tab 102 does not extend all the way across tab 101, or with tab 102 extending beyond the end of tab 101. The tab allows for the user to adjust the closure of the glove to the selected size without restrictions on the degree of adjustment.

In the past, magnet technology has not been suitable for use as closure mechanisms due to the rigidity of the magnetic materials and the inability to achieve required magnetic fields strengths in reasonable low weight structures. As a result, Velcro® and snap technologies have tended to predominate in the golf and sport glove areas where proper snugness and adjustability is indicated. This is also true for hats and other similar garments and bags.

Currently, there are various types of magnets which are utilized. These include sintered hard Ferrite, bonded Samarium Cobalt magnets and Nd-Fe-B polymer bonded magnets. There are various types of magnets having different magnetic field strengths, generally identified as BH Max. For Ferrite magnets, which are generally used as sheet magnets and other uses, a range of between 0.20–2.00 BH Max is available. For Alnico magnets, which are often used in motors, a BH Max of between about 3.00–10.00 is achievable. For Samarium Cobalt magnets which are often used in motors, CT and the like a BH Max of 10.00–20.00 is achievable. However, with a Nd-Fe-B magnet, which is currently used in telephones and computers, a BH Max of 20.00–40.00 is achievable. In addition, Barium Iron Oxide magnets impregnated in a soft plastic carrier have been found to have strong magnetic fields and are easier to process than the Neodymium magnets. Generally, a level of 400–500 Gauss can be achieved with the Barium Iron Oxide Magnets.

For purposes of use in a closure mechanism the Barium Iron Oxide magnets are the current preferred embodiment, and are currently, preferably prepared as separate tab pieces, rather than being manufactured in a tape format. The Neodymium magnets and also Strontium iron oxide magnets are current embodiments with desirable characteristics. In one current embodiment with the Neodymium magnets the tape is prepared with a thickness of about 0.4 millimeters with a width of about 200 millimeters in a roll 25 meters long, which is cut to size and used to make the tabs. Alternatively, the tabs can be manufactured as separate pieces, which in a current preferred embodiment are either two inches by two inches or two inches by three inches. The tabs can be fixed to the two portions of the glove which are adapted to receive the closure either by a pressure or heat based adhesive on the tape, by stitching or by some combination of tape adhesive and stitching or other connection approach. Generally, the magnet tape is designed to provide a comparable degree of connection as the Velcro® pads provide.

In operation, the wearer would generally open up the magnetic tabs to open the glove as shown in FIG. 1. The glove would then be slid onto the wearer's hand and then the required degree of tautness or pressure would be established and the magnetic tab 102 would be rested against magnetic tab 101.

In a preferred embodiment of the invention a magnetic closure in the glove is formed with magnetized ferro impregnated plastic both on the back of the glove and on the tab portion which contacts with and grips the opposed piece at an adjusted degree of tightness.

In another preferred embodiment the magnetized ferro impregnated plastic ideally consists of iron oxide blended with barium carbonate and should be in a range of 0.020 to 0.080 inches and more preferably 0.035 inches to 0.060 inches thick. Ranges beyond this are possible but, based upon the restraints of placement on the back of the golf glove or other close fitting sports or work glove, thickness in the noted range provides optimum matching of strength together with flexibility. The opening in golf and other gloves can also be on the palm or along the side of the hand. Each of these approaches is enabled by the closure mechanism constructed in accordance with the invention. Generally, increased strength and flexibility of placement and adjustability are improved as the concentration of poles in connection with the magnetization is increased. The "poles per inch" magnetization required for a glove depends to a certain extent on the force that will be utilized against the glove. In the event that only a relatively loose closure is required lesser strength and a smaller number of poles per inch would be required. Generally, in connection with a golf glove or other similar sport glove a magnetic closure with steel inserts having four poles per inch for the magnet in a checkerboard pattern tends to provide marginally acceptable magnetic closure strength and adjustability. In a preferred embodiment a poles per inch magnetization of 10 or more is recommended. A current preferred embodiment has 18 poles per inch. This allows for more adjustability (as the closure tab tends to jump and lock in place from pole row location to pole row location) . Generally a range of 4 to 20 poles per inch is considered desirable with a preferred range of 10 to 18 poles per inch. In addition, the pole pattern of magnetization is preferably a "checkerboard" pattern which most readily allows the opposing magnets to bond even if placed at an angle. In a current preferred embodiment, a magnetic field of about 300–500 Gauss is achieved with a 10 pole per inch embodiment.

The holding power of the magnetic closure increases and also the closure becomes more adjustable when both sides of the closure are magnetized, as opposed to one side being a non-magnetized Ferro plastic and if both sides are backed by flexible steel foil. With an appropriately strong magnet on one surface a non-magnetized ferro-plastic could be used for the other closure member. The thickness of the flexible steel foil, to achieve maximum results, should vary inversely with the number of poles per inch of the magnetized material, according to a formula in which the direct polar force is equal to 0.577 times the flux density squared divided by area. For example, a preferred thickness of stainless steel for 10 poles per inch material is approximately 0.006 inches. For a similar closure with four poles per inch, a thickness of stainless steel of 0.024 inches would be indicated. Preferably, the steel foil used in the magnetic closure should ideally be silicon steel, painted or otherwise coated to prevent rusting which would occur from contact with the glove wearer's sweat. If a 10 pole per inch magnet is used with silicon steel, a thickness of only approximately 0.005 inches is required. In the event that an 18 pole per inch magnet is used a stainless steel layer of approximately $4/1000$ of an inch is required while a silicon steel layer of approximately $3/1000$ is necessary. So, with the silicon steel the backing layer can be made thinner and therefore sewable, which is preferred.

It is desirable that the magnetic pattern, regardless of poles per inch, be in a "checkerboard" format. Other patterns include lines, zigzags or random magnetic sites. These could work as well, but the checkerboard pattern gives the best adjustability and is multidirectional.

In another preferred embodiment of the invention through empirical testing a steel thickness with a ten pole per inch checkerboard pattern produced an optimum thickness of two mils. The steel backing improves the magnetic holding force of the magnetized ferro impregnated plastic by conducting the magnetic flux lines on the back surface of the magnetic plastic through the steel foil and concentrating the magnetic force on the front, contacting surface of the magnetized plastic. To the extent that the magnetic flex lines extend out of the steel foil this is generally an indication that there is inadequate steel present and the magnetic flex has oversaturated the capacity of the steel. It also has the effect of weakening the magnets' holding power.

Figure 2:
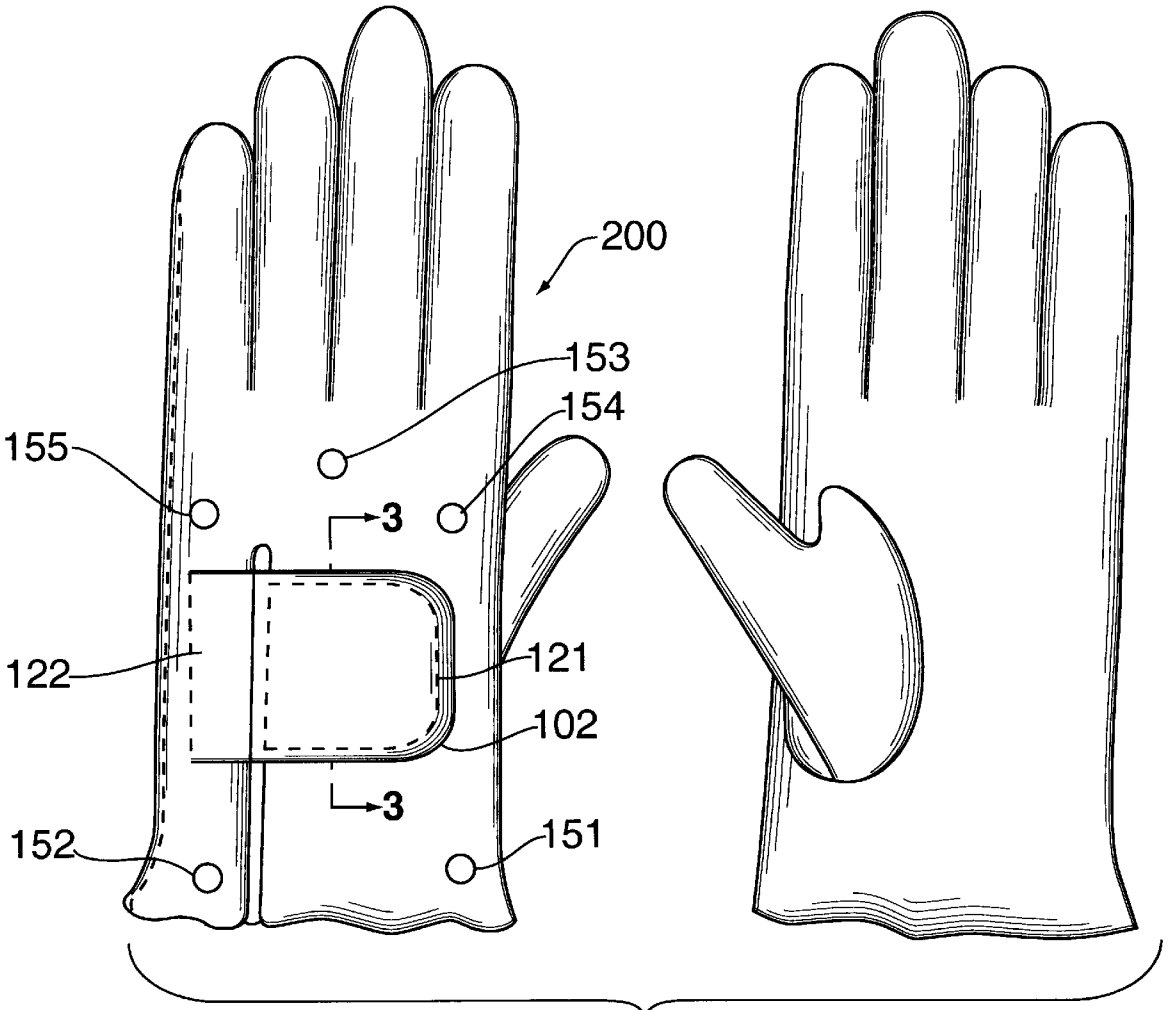
FIG. 2 is a top elevational and bottom elevational view of a golf glove constructed in accordance with another preferred embodiment of the invention.
Figure 3:
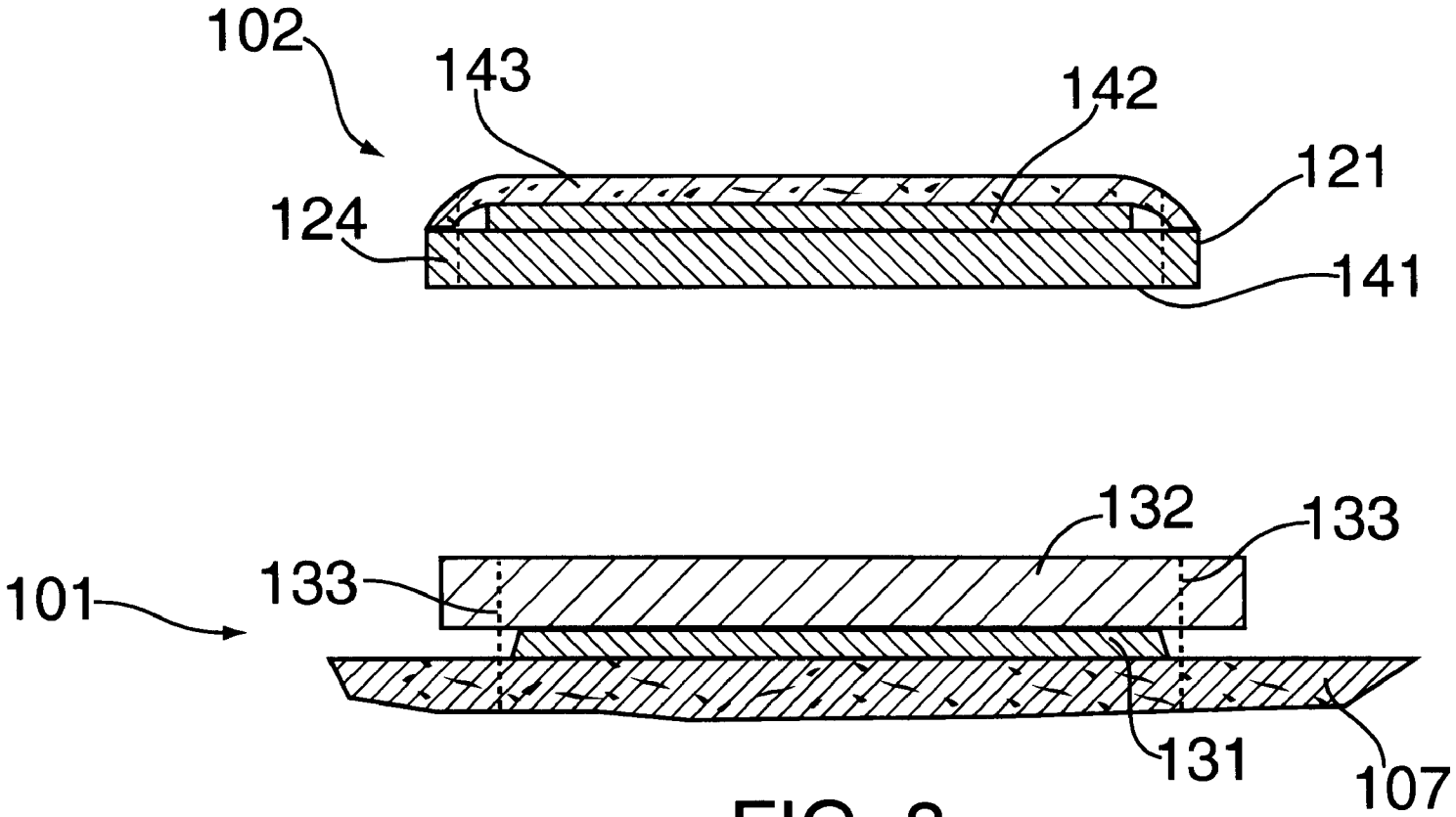
FIG. 3 is a enlarged cross-sectional view taken along line 3—3 of FIG. 2.

Reference is next made to FIGS. 2 and 3 in which a glove incorporating a closure mechanism constructed in accordance with another preferred embodiment of the invention, generally indicated as 200, is depicted. Like elements are represented by like reference numerals. Glove 200 includes magnetic flap 102 and underlying magnetic connector 101. The magnetic flap is secured to glove 200 through a generally elastic connection 122 in accordance with conventional technology. As better seen in Fig. 3, outer flap 102 includes magnetic member 141, steel backing layer 142 and leather covering layer 143, held together by stitching 121 extending through leather layer 143 and magnetic layer 141. As better seen in FIG. 2, the stitching 121 extends generally around the perimeter of flap 102 and steel layer 142 is made slightly smaller than the dimensions of magnetic layer 141 so that the sharp edges of steel layer 142 are retained inside of leather layer 143 and magnetic layer 141. Effectively, steel layer 142 sits in a closed pocket formed by magnetic layer 141 and leather cover 143. While it is possible to stitch through steel layer 142 because of its relatively thin size, it is preferable not to stitch through the steel. The steel tends to dull and damage the sewing needles such that frequent replacements are necessary. With a pocket arrangement there is no need to sew through the steel layer.

Lower connector flap 101 includes a glove layer face panel 107, steel layer 131 and magnetic layer 132, stitched together around the perimeter of magnetic layer 132 with stitching 133. Again, the steel backing layer 131 is maintained in a pocket so that it is not necessary to stitch though and the sharp edges are covered by the leather layer 107 and flexible magnetic layer 132.

The magnetic layers 132 and 141, in a preferred embodiment, have between 10 and 18 poles per inch on one surface of the barium iron oxide material embedded in the flexible magnetic layer. Various possible plastic layers may be utilized such as polyvinyl chloride, polyurethane, nitrile, nordel, natsyn. In addition, where the material is made by injection molding, nylon 12, polyamides and HT resin may be used. Other similar materials with advantageous physical characteristics may likewise be used as the carrier for the magnetic materials. In current preferred embodiments, the materials are formed in sections which are in appropriate size for the pads. However, the process for manufacturing can be converted to a continuous process which will produce a tape which can then be cut as desired.

It is also possible, in an effort to increase the magnetic flux generated by the magnetic members, to magnetize both surfaces of the magnetic material so that two separate sheets of magnetic material are effectively provided in the single physical member. Further enhancements in magnetic materials and patterns can be incorporated into the closure structure The closure mechanism incorporating the magnets can also be used as closures for shirts, pants and other garments, shoes and even containers.

In addition to the use of the magnetized ferro impregnated plastic for a closure mechanism, it may also be used for a ball marker. Generally, ball markers are formed as circular discs which are placed on the putting surface directly behind the ball's location to allow the golfer to clean and reposition the ball as well as a means to avoid interfering with the ball movement of another golfer on the green. By making these discs out of magnetized ferro impregnated plastic they can be made extremely thin and can be placed in a variety of locations on the glove. They could also be made of a non-magnetic, but magnetizable material, which would adhere to a magnet. This second approach is preferred as it allows the ball markers to be made of inexpensive steel or other non-magnetic material rather than more expensive magnets. In this way a series of markers can be provided in the event one is misplaced or lost. They can be placed either on the closure portion on the tab or the base of the hand, for golf glove constructions or placed in other locations as indicated. See Fig.2 in which markers 151, 152, 153, 154 and 155 are shown at different places around the glove which don't interfere with the flexibility of the glove. In practice, there would only be one or two markers on an actual glove. Generally, a flexible steel foil piece or a magnet (depending on the approach) secured to the glove in the desired spots is all that would be required in these scenarios to achieve the desired result.

The magnetic tabs constructed in accordance with a preferred embodiment of the invention are generally flexible and relatively soft materials which flex with the wearer's hands so that in use they do not either interfere with movement of the hand or cause chafing or other discomfort by the wearer. However, with the development of calendared magnets, rare earth magnets such as those involving Neodynium, Barium Iron Oxide and Strontium Iron Oxide and other new technologies, magnets with comparable holding force to those Velcro®, the traditional glove closure are available. In a preferred embodiment, the magnet materials can be impregnated into soft, stitchable plastic tabs which can then be stitched to the appropriate locations on the golf glove.

The technology associated with the quiet, broadly adjustable closure is applicable to other types of gloves, including baseball gloves, bicycle gloves and other sport gloves and industrial, work or dress gloves. It may also be utilized in connection with closures for flexible footwear such as wetsuit materials and moccasins, hats, pocket closures and the like.

The magnetic closure technology is particularly appropriate for use in hunting gloves because silence is a critical aspect to the hunting process. With Velcro® closures the distinctive ripping sound of the Velcro® separating can tip off the hunter's presence.

The quiet adjustable magnetic closure technology can also be used in connection with small bags, wallets, handbags, knapsacks, pocket closures in connection with garments and bags of various sorts. In particular, in applications where currently Velcro® is used but the bulkiness, noise and appearance of the Velcro® is undesirable, the magnetic strips or tapes can be utilized.

In a preferred embodiment, to increase the holding power of the magnets and to make more accurate and repeatable adjustability possible, the molded plastic sheet containing the magnetic materials can have grooves or another textured pattern molded into their surface forming mating ridges.

In addition, because the magnetic connection does not require there to be actual contact between the two magnetic components or the one magnetic component and mating metal component, these materials can be hidden within the fabric of the gloves so that there is no apparent closure present and the wearer would not see the connection. This can be accomplished either by creating a pocket region within each of the areas in which the connecting magnetic material is to be placed or by impregnating the magnetic material into the actual fabric in which the glove is formed. This could be accomplished by sewing portions of the glove which include the magnetic materials to the other portions of the glove.

Accordingly, an improved quiet adjustable closure for golf gloves and other sport gloves, which provides for an improved closure incorporating one or more magnetic panels which mate with each other or a magnetic panel mating with a metallic station to form the silent glove closure, is achieved.

It will thus be seen that the objects set forth above, among those made apparent in the proceeding description, are efficiently obtained and, since certain changes may be made in the above constructions and processes without departing from the spirit and scope of the invention, it is intended that all matter contained in the above description or shown in the accompanied drawings shall be interpreted as illustrative, and not in the limiting sense.

It will also be understood that the following claims are intended to cover all of the generic and specific features of the invention, herein described and all statements of the scope of the invention which, as a matter of language, might be said to fall therebetween.

What is claimed is:

1. A glove, comprising:

a palm portion;

a back portion;

finger and thumb portions;

an opening in either the back portion, the palm portion or between the back and palm portions;

a flap portion secured to either the palm portion or the back portion for extending over the opening and mating with a bonding location on either the palm portion or the back portion; and a magnetic closure including a first magnetic member coupled to the flap portion and a second magnetic member coupled to the bonding location, proximate the opening, formed from a soft magnet, wherein the second magnetic member on the bonding location further includes a metal backing layer to concentrate magnetic flux from the second magnetic member toward the magnetic closure on the flap, whereby a comfortable, adjustable and quiet opening closure is provided which enhances fit without distracting noise when the magnetic closure is opened.

2. The glove of claim 1 wherein the opening is in the back portion of the glove and the bonding location is on the back portion of the glove.

3. The glove of claim 1 wherein the first and second magnetic members include barium iron oxide in a flexible carrier material.

4. The glove of claim 3 wherein the magnetic closure includes a stainless steel or silicon steel plate adjacent to each of the first and second soft magnetic members.

5. The glove of claim 3 wherein the first and second magnetic members are formed with a series of poles organized in a checkerboard pattern.

6. The glove of claim 5 wherein the first and second magnetic members have between 4 and 20 poles per inch.

7. The glove of claim 6 wherein the first and second magnetic members have between about 10 and 18 poles per inch.

8. The glove of claim 5 wherein at least one of the magnetic members has magnetic poles on two opposing surfaces of the at least one magnetic member.

9. The glove of claim 1 wherein the first magnetic member is sewn to the flap portion and the second magnetic member is sewn to the glove.

10. The glove of claim 9 wherein the glove further includes a silicon steel or stainless steel disc between the flap and first magnetic, member sewn to the flap.

11. The glove of claim 9 wherein the glove further includes a silicon steel or stainless steel disc sewn between the glove surface and the second magnetic member.

12. The glove of claim 1 wherein the first and second magnetic members include at least one of barium iron oxide, strontium iron oxide and neodymium in a flexible carrier.

13. A glove including a marking device comprising:

a palm portion;

a back portion;

finger and thumb portions;

an opening for receiving a wearer's hand;

a first pad member secured to the glove;

a marker having a size and shape similar to the first pad member;

one of the pad member and marker members being formed of a magnetic material, the other of the marker and pad members being formed of a material which will be attracted by a magnet;

whereby a removable marker produced in connection with a glove is provided.

14. The glove of claim 13 wherein the pad member is formed of a magnetic material and the marker is formed of a magnetizable material adapted to be releasably connected to the glove.

15. The glove of claim 13 wherein the pad member is attached to the glove at a position which does not interfere with the use of the glove.

* * * * *